US005257509A

United States Patent [19]

Harris

[11] Patent Number: 5,257,509

[45] Date of Patent: Nov. 2, 1993

[54] CONVERTIBLE BRIEFCASE, FOOD AND BEVERAGE CARRIAGE, AND MINI-COOLER

[76] Inventor: Larry C. Harris, 262 King St., Apt. 713, Pottstown, Pa. 19464

[21] Appl. No.: 935,052

[22] Filed: Aug. 24, 1992

[51] Int. Cl.[5] ..... F25D 3/08

[52] U.S. Cl. ..... 62/326; 62/457.5; 62/457.7; 150/106; 190/1; 206/544; 206/545; 206/546

[58] Field of Search ..... 62/326, 457.2, 457.3, 62/457.4, 457.5, 457.7; 165/918, 919; 190/1; 150/106; 206/544, 545, 546; 220/528, 529, 344

[56] References Cited

U.S. PATENT DOCUMENTS

| | | | |
|---|---|---|---|
| 1,867,455 | 7/1932 | Humphrey | 206/544 |
| 4,106,597 | 8/1978 | Sheok et al. | 190/42 |
| 4,344,301 | 8/1982 | Taylor | 62/457.5 |
| 4,441,336 | 4/1984 | Cannon | 62/457.5 |
| 4,446,705 | 5/1984 | Loucks | 62/457.5 X |
| 5,095,718 | 3/1992 | Ormond et al. | 62/457.3 |
| 5,125,531 | 6/1992 | Wentz | 220/344 |

*Primary Examiner*—William E. Tapolcai
*Attorney, Agent, or Firm*—Ratner & Prestia

[57] ABSTRACT

A container converting between a briefcase, a food and beverage carriage, and a mini-cooler. The container has a case which functions as a briefcase. The case includes a base and a top, each of which has walls defining a hollow center filled with insulating material. The top is secured by a hinge to the base along coextensive edges. A plurality of separate food and beverage carriage inserts may be removably positioned in the base to convert the case into a food and beverage carriage. An insulating mini-cooler adapter converts the case into a mini-cooler.

47 Claims, 5 Drawing Sheets

CONVERTIBLE BRIEFCASE, FOOD AND BEVERAGE CARRIAGE, AND MINI-COOLER

FIELD OF THE INVENTION

This invention relates generally to briefcases, to insulated food or drink carriages, and to coolers, and, more particularly, to a container which converts from a briefcase to a carriage which stores and transports simultaneously hot and cold foods and beverages and to a six-pack mini-cooler.

BACKGROUND OF THE INVENTION

Members of the working force today are extremely busy people. They have little time to prepare either lunch or dinner. Often, they move between the office and leisure-time activities, and vice-versa, without having time to stop at home. Such busy people are bound to use vending machines or to eat in restaurants for sustenance. The quality of food in the former is often lacking and the time and expense inherent in restaurant dining often render the latter undesirable. Moreover, certain people prefer foods and drinks tailored to their life-style which are sometimes unavailable from vending machines and restaurants.

Accordingly, many people find it desirable, necessary, or both to carry their own lunch or dinner with them. This improves ease and convenience, saves time and money, and assures a wider variety of foods and beverages tailored to an individual's preference. Typically, paper sacks, plastic bags, or lunch boxes are used to carry the lunch or dinner. Such receptacles are often cumbersome to carry and offer little protection against spoilage. Moreover, absent an available refrigerator and microwave or conventional oven, food and beverages, whether tastier hot or cold, both must be consumed in the lukewarm state at room temperature.

In addition, many people feel that carrying a meal to work in the typical receptacles is embarrassing. Some believe it hurts their corporate, professional, or fashionable image. They desire, therefore, a carriage which has an attractive exterior appearance offering the prestige of a briefcase.

When not working, people engage in a wide variety of leisure activities for which cool beverages are a desirable complement. A number of coolers are available to transport and cool beverages. The busy worker may not have time, however, to stop at home to pick up a conventional cooler. That worker also may be unable to carry both a lunch carriage and a cooler to work. Therefore, a versatile container which can function both as a meal carriage and as a six-pack mini-cooler is needed. If that container could function as a briefcase when not in use as a meal carriage or as a six-pack mini-cooler, an additional advantage would be attained.

Others have suggested carrying food in briefcases with specially and permanently constructed interior structures. Such specially constructed cases preclude the option of using the case solely as a briefcase or as a mini-cooler. The permanent nature of the interior structures also makes washing and cleaning difficult and possibly harmful to the case. Still others have suggested designs which do not provide insulation. Such designs fail to retain food and drink at widely divergent temperatures such as would be appropriate for hot food and cold drink. Shook et al., in U.S. Pat. No. 4,106,597, disclose an executive food carrying case. A single, removable insert is suggested for converting a conventional briefcase into a food carrying case; the case is always available for carrying papers and is additionally available when desired on a temporary basis to carry food. Food is transported in the insert, which may be cut or trimmed to fit the briefcase.

The insert is a single block of thermally insulating foam, smaller than the interior of the briefcase, with a plurality of cavities formed in one of its major surfaces to receive food. The foam block may be cooled in a refrigerator or heated in a microwavebut, of course, not simultaneously. Thus, items in cold containers would match, for example, a cooled insert well while heated containers would not. Removal of the single block is also problematic; notches and finger holes must be provided to facilitate removal. Moreover, the entire insert must be removed and cleaned even though only a single cavity may be dirty.

A covering lid is pivotally mounted to the block over the major surface having the cavities for at times protectively covering and retaining the food items in those cavities. The food is compressibly retained at such times by foam attached to the underside of the lid. The top of the lid is sufficiently smooth and flat to form a writing work surface. A pressure sensitive latch can hold the lid closed or fasten the lid to the opened part of the briefcase to hold the lid open during use.

Because the case is a combination briefcase and food carrying case, the insert is sized to allow a space above the insert and within the hinged top of the briefcase to store and transport business documents. Accordingly, less than the entire interior of the case is available to carry food and beverages. Moreover, no provision is made to convert the case into a cooler.

To overcome the shortcomings of existing briefcases, food and beverage carriages, and six-pack coolers, a new, convertible, briefcase, food and beverage carriage, and mini-cooler is provided. An object of the present invention is to provide all of the advantages of transporting a meal, including savings in time and money, a broader selection of food and beverage items, and the opportunity to follow a preferred diet, such as a religious, health, or weight-loss diet. Another object is to appeal to the prestige or status minded person by concealing the fact that the container carries a meal. A related object is to provide an aesthetically designed container which resembles a briefcase.

Still another object is to provide a container which can effectively and efficiently transport food and drink while safely preserving it so that it can be consumed at an appropriate temperature at any convenient time. A related object is to effectively protect food and drink from undesirable temperature fluctuations and from physical damage.

An additional object is to provide a container which can function as a conventional briefcase to carry documents, computer disks, and other paraphernalia; can convert entirely into a food and beverage carriage; and can convert yet again completely into a mini-cooler.

SUMMARY OF THE INVENTION

To achieve these and other objects, and in view of its purposes, the present invention provides a container converting between a briefcase, a food and beverage carriage, and a mini-cooler. The container has a case which functions as a briefcase. The case includes a base and a top, each of which has walls defining a hollow center filled with insulating material. The top is secured by a hinge to the base along co-extensive edges. A plurality of separate food and beverage carriage inserts may be removably positioned in the base to convert the case into a food and beverage carriage. An insulating mini-cooler adapter converts the case into a mini-cooler.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which:

FIG. 3A is a top view of a thermos insert;

FIG. 3B is a side view of the thermos insert shown in FIG. 3A;

FIG. 4 is a perspective view of a partition insert;

FIG. 5 is a perspective view of a chamber insert;

FIG. 6A is a side view of a drinking cup insert;

FIG. 6B is a top view of the drinking cup insert shown in FIG. 6A;

FIG. 7 is a perspective view of the container constructed according to the present invention with a number of inserts in place to convert the container into a food and beverage carriage;

FIG. 8 is a perspective view of the container constructed according to the present invention showing a number of inserts, different from those shown in FIG. 7, in place to convert the container into a food and beverage carriage;

FIG. 9A is a top view of a single can insert;

FIG. 9B is a front, cross-section view of the single can insert shown in FIG. 9A;

FIG. 9C is a side view of the single can insert shown in FIGS. 9B and 9C;

DETAILED DESCRIPTION OF THE INVENTION

Figure 1A:
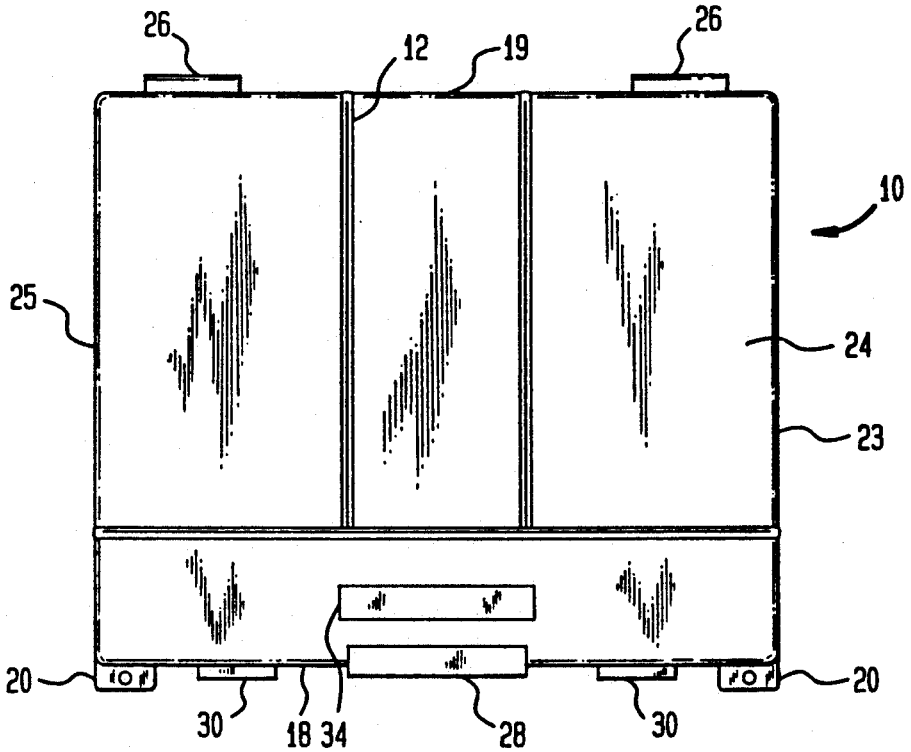
FIG. 1A is a top view of a container constructed according to the present invention.
Figure 1B:
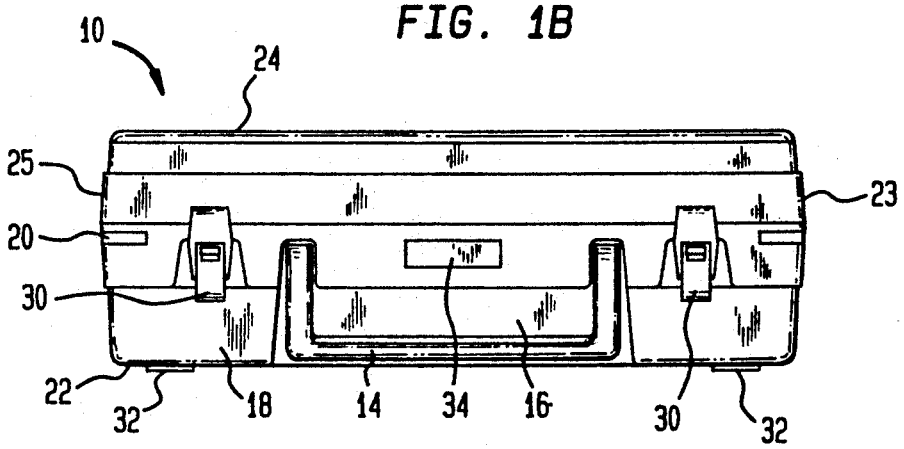
FIG. 1B is a front view of a container constructed according to the present invention.
Figure 1C:
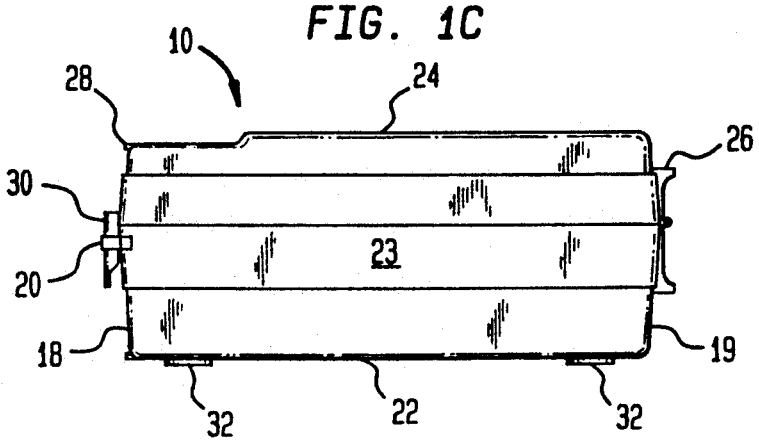
FIG. 1C is a side view of a container constructed according to the present invention.

Referring now to the drawing, wherein like reference numerals refer to like elements throughout, FIG. 1 shows a container 10 constructed in accordance with the present invention. FIGS. 1A, 1B, and 1C show container 10 from a top, front, and side perspective, respectively.

Container 10 is aesthetically designed to be distinctive, fashionable, and handsome; it somewhat resembles a briefcase and may have a leather-like covering secured along stitch lines 12. Container 10 is constructed of a strong, durable, lightweight material such as a resinous plastic. High-impact styrene is suitable. It is compact, having approximate dimensions of 11.5×8.5×3.5 inches, which permits easy storage in a small area and easy transport. A wide variety of sizes, shapes, and designs for container 10 are possible and the embodiment of the invention described is exemplary only.

A recessed, collapsible handle 14 is provided to carry container 10. Handle 14 fits snugly within recess 16 in front 18 of container 10. A double-stitched, adjustable, leather shoulder strap (not shown) may be provided to facilitate transport; loops 20 are provided on front 18 of container 10 for attaching such a strap.

Container 10 has a base 22, a top 24, a right side 23, and a left side 25. Top 24 is secured by hinges 26 to base 22 along their co-extensive rear edges. Hinges 26 are shaped to allow container 10 to stand on hinges 26 in a stable position. Such stability is especially helpful when container 10 is transported in a moving vehicle such as a car, train, bus, or plane.

A ridge 28 may be provided in top 24 for easy manipulation of top 24 when opening and closing top 24. A pair of clasps 30 are provided, as known in the art, to secure top 24 in closed position against base 22. Clasps 30 typically have a latch attached to the front of top 24 and a corresponding latching arm attached to the front of base 22. Feet or pads 32 on base 22 of container 10 protect the leather-like covering when container 10 rests on another structure. A nameplate 34 may be affixed to top 24 (FIG. 1A) or front 18 (FIG. 1B) of container to enhance its stylish appearance and to identify its owner. Container 10 has a rear 19 opposite front 18.

Figure 2C:
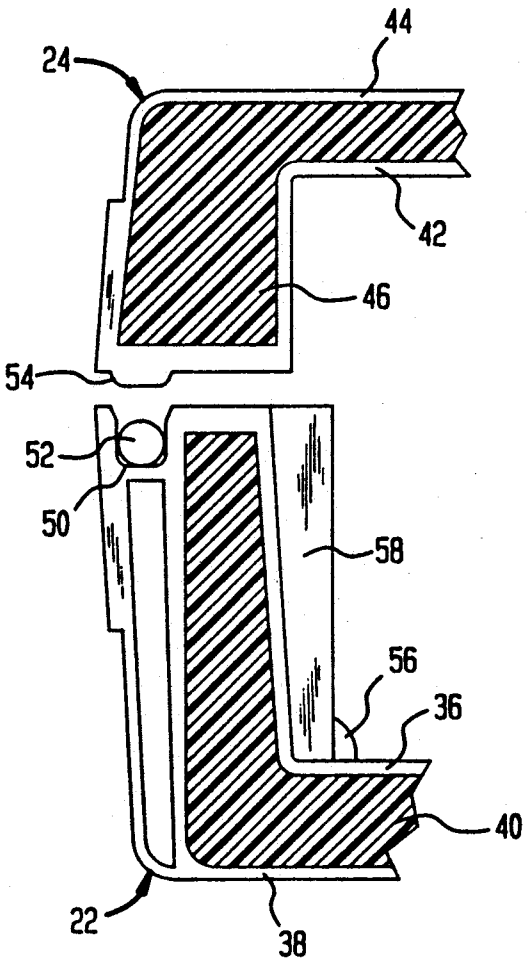
FIG. 2C is a detailed view of the cross-sectional view shown in FIG. 2B highlighting the O-ring construction of a container constructed according to the present invention.
Figure 2A:
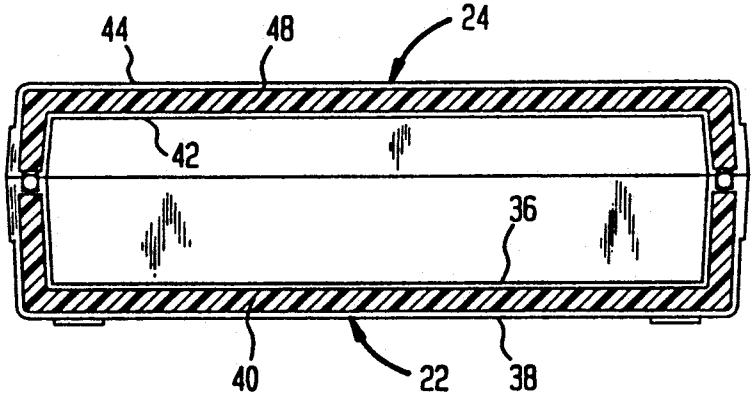
FIG. 2A is a cross-sectional front view of a container constructed according to the present invention.
Figure 2B:
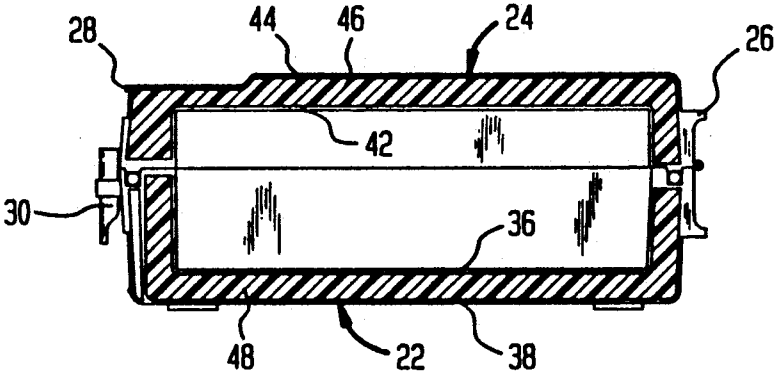
FIG. 2B is a cross-sectional side view of a container constructed according to the present invention.

As shown in the cross-sectional views of FIGS. 2A, 2B, and 2C, base 22 of container 10 has inner wall 36 and outer wall 38 to form a hollow center 40. Similarly, top 24 of container 10 has inner wall 42 and outer wall 44 to form a hollow center 46. Both hollow center 40 of base 22 and hollow center 46 of top 24 are filled with a thermally insulating material 48 so that container 10 is insulated. High impact foam insulation, which may be injected into hollow centers 40, 46, is suitable as thermally insulating material 48. Air may be a suitable insulating material for some applications.

As shown in FIG. 2C, base 22 of container 10 has a channel 50 located along the entire periphery of base 22. An O-ring 52 is provided in channel 50. O-ring 52 is made of a compressible, insulating material such as rubber. Top 24 of container 10 has a lip 54 located along the entire periphery of top 24. When top 24 is closed over base 22, lip 54 engages channel 50, contacts O-ring 52, and compresses O-ring 52 somewhat to assure a vacuum-tight, leakproof seal between top 24 and base 22 of container 10.

Container 10 can carry small books, magazines, papers, delicate and sensitive items (e.g., compact disks, tapes, computer disks, calculators, film, cameras, and the like), and other paraphernalia..functioning just as a conventional briefcase. Alternatively, container 10 is sufficiently small that it can fit inside most conventional briefcases. The compact size of container 10 is especially useful when container 10 is converted to a food and beverage carriage or to a mini cooler, as described below.

FIGS. 3A, 3B, 4, 5, 6A, 6B, 7, 8, 9A, 9B, and 9C show various exemplary inserts which convert container 10 into a food and beverage carriage. The walls of each insert define cavities which are filled with a gel, air, or other suitable insulating material. Certain insulating materials, such as a gel, allow each insert to be heated or cooled and to retain its temperature nearly constant for a number of hours. A commercially available gel sold by Midland Chemicals under the trademark POLAR-PACK is suitable.

Thus, one insert could be frozen so that the food or beverage contained in that insert will remain cold while a second insert could be heated so that the food or beverage in that second insert will remain hot. The two inserts can be placed adjacent one another inside container 10. Thus, when container 10 is used as a food or beverage carriage, it can retain food and drink at widely divergent temperatures such as would be appropriate for hot food and cold drink.

Figure 3A:
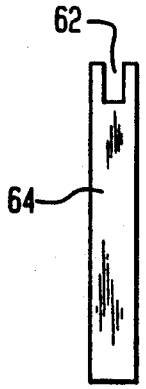
FIGS. 3A, 3B, 4, 5, 6A, 6B, 7, 8, 9A, 9B, and 9C show various exemplary inserts which convert the container constructed according to the present invention into a food and beverage carriage, specifically.
Figure 3B:
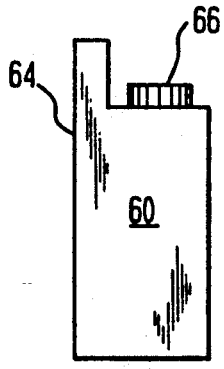

Shown in FIGS. 3A and 3B is a thermos insert 60. FIG. 3A illustrates a slot 62 cut into the top 64 of thermos insert 60. Slot 62 is designed to engage rib 56 (see FIG. 2C) near base 22 of container 10. Such engagement positions thermos insert 60 within container 10 and secures thermos insert 60 against undesired movement during transport. To facilitate securing thermos insert 60, the length of thermos insert 60 is designed to wedge it between rear 19 of container 10 and a projection 58 located on the inside of front 18 of container 10. A cap 66 on thermos insert 60 allows access to the contents, typically a beverage, of thermos insert 60. A conventionally round thermos insert 60 could also be provided.

Figure 6A:
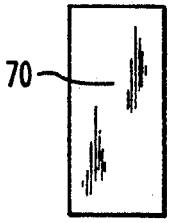
Figure 6B:
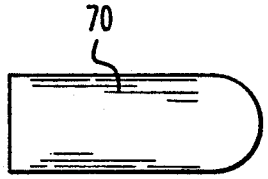

A drinking cup insert 70 may be provided as one of the inserts. As shown in FIGS. 6A and 6B, the shape of hollow drinking cup insert 70 allows drinking cup insert 70 to fit over cap 66 of thermos insert 60. When in position over cap 66 inside container 10 (see FIG. 7), drinking cup insert 70 prevents drips and spills of the beverage contained within thermos insert 60. Drinking cup insert 70 is held in position within container 10 by wedging it between thermos insert 60, projection 58, and top 24 of container 10.

Figure 5:
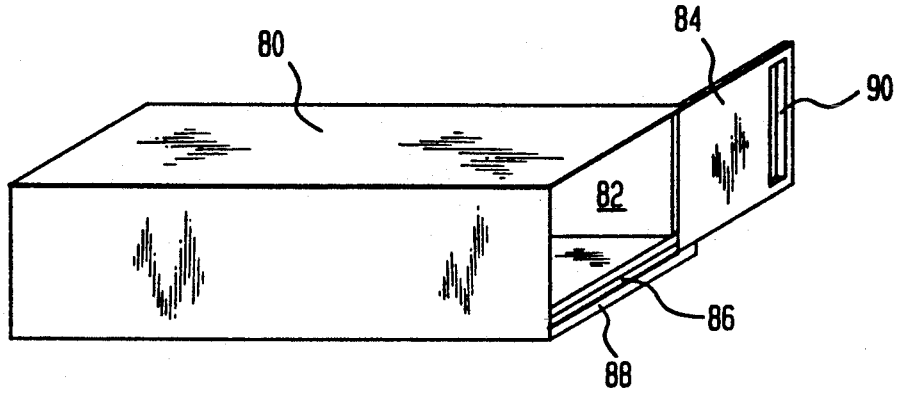

As shown in FIG. 5, a chamber insert 80 is also one of the inserts which converts container 10 into a food and beverage carriage. Chamber insert 80 is rectangular and defines an opening 82 suitable for holding standard, plastic, food receptacles such as those marketed under the RUBBERMAID and TUPPERWARE trademarks.

Chamber insert 80 is provided with a front door 84. As shown in FIG. 5, front door 84 may slide along track 86 formed in the front wall 88 of chamber insert 80. A handle 90 allows front door 84 to be opened and closed. Sliding front door 84 saves space and prevents thermal exchange between opening 82 and the outside of chamber insert 80.

Alternatively, front door 84 may be provided with a pivot hinge along one edge allowing it to swing relative to chamber insert 80 into its open and closed positions. Front door 84 might also be snapped into and out of engagement with chamber insert 80 over opening 82.

Figure 7:
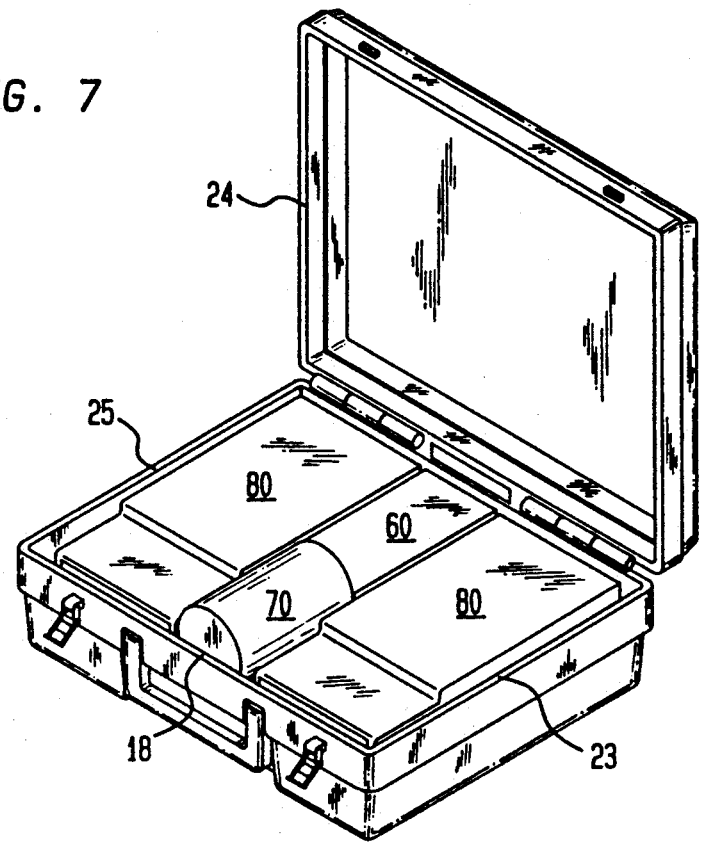

Thus, hot or cold food items, stored in a receptacle, are slid inside chamber insert 80 in opening 82 with front door 84 open. Front door 84 is then closed and chamber insert 80 is inserted within container 10 for transport. The dimensions of chamber insert 80 are chosen so that chamber insert 80 is wedged between rear 19, projection 58, base 22, and top 24 of container 10. Moreover, as shown in FIG. 7, container 10 can accommodate more than one chamber insert 80.

Figure 4:
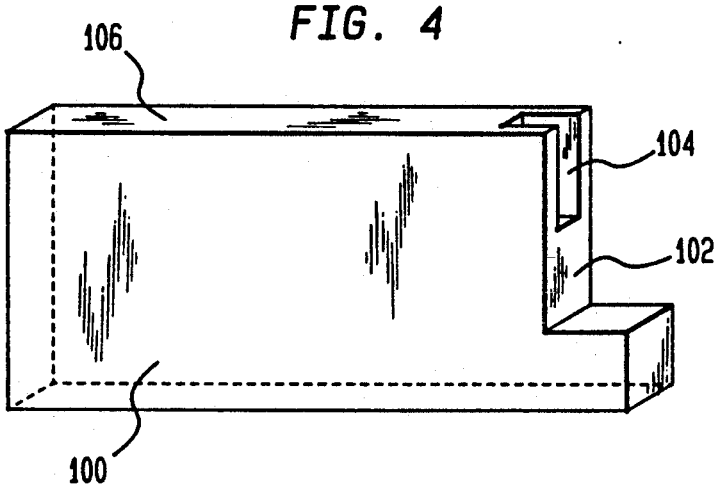

FIG. 4 illustrates a partition insert 100. Partition insert 100 is substantially rectangular in shape with an L-shaped cutout 102 in one end. A groove 104 is provided in the bottom 106 and along one leg of cutout 102 of partition insert 100. Groove 102 engages rib 56 (see FIG. 2C) near base 22 of container 10. Moreover, cutout 102 engages projection 58 of container 10 (see FIG. 8). Both types of engagement position partition insert 100 within container 10. To facilitate securing partition insert 100, the length of partition insert 100 is designed to wedge it between rear 19 and projection 58 of container 10.

Figure 8:
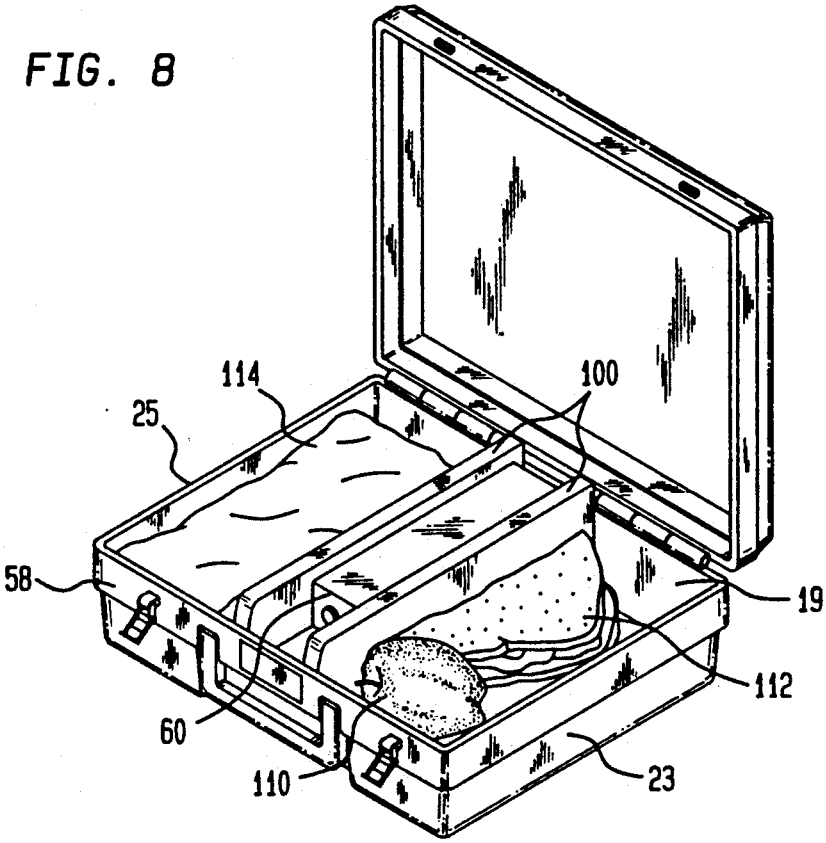

As shown in FIG. 8, a plurality of partition inserts 100 may be used in container 10. Partition inserts 100 insulate food items such as fruit 110, sandwich 112, chips (inside bag 114), and other food receptacles (not shown). Partition inserts 100 also divide the inside of container 10 into a number of areas for holding different items and gently wedge the contents inside container 10 against undesired movement during transport.

Figure 9A:
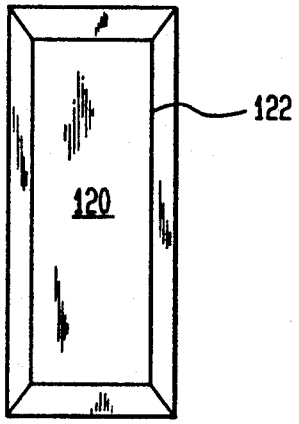
Figure 9C:
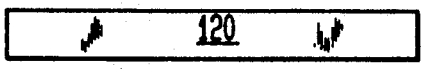
Figure 9B:
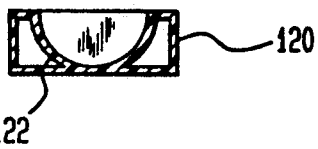

FIGS. 9A, 9B, and 9C show a can insert 120. As shown best in FIGS. 9A and 9C, can insert 120 is substantially rectangular in shape. The dimensions of can insert 120 are chosen so that can insert 120 is wedged between rear 19, projection 58, base 22, and top 24 of container 10. As shown in FIG. 9B, can insert 120 has a cylindrically shaped trough 122 to accommodate single cans and bottles having a variety of shapes and sizes and typically holding 12-ounces of a beverage.

As shown in FIGS. 7 and 8, the various inserts are designed to fit snugly within container 10. The height of the inserts allows them to contact both container base 22 and container top 24. The length of the inserts allows them to contact both container rear 19 and projection 58. Moreover, the widths of the various inserts allows them to contact each other and the right side 23 of container 10 or the left side 25 of container 10. Thus, the inserts are wedged in position and maximize use of the interior space within container 10.

Alternatively, one or more additional plate inserts (not shown) could be provided between the container base 22 and the bottom of the inserts, between the container top 24 and the top of the inserts, between the container rear 19 and the back of the inserts, between the projection 58 and the front of the inserts, between the right side 23 and the side of the inserts, or between the left side 25 and the opposite side of the inserts, to further fix and insulate the food or beverage-carrying inserts inside container 10.

The inserts simultaneously insulate, separately, hot and/or cold stored foods and beverages for several hours at controlled temperatures. A wide variety of accessory inserts are feasible as would be known by one of ordinary skill in the in the plastic food container industry. Container 10 and its inserts are reusable, unlike plastic and paper lunch bags, which addresses prevalent environmental concerns.

Moreover, container 10 and its inserts are easy to clean; the inserts are dishwasher safe. The inserts can be removed easily from container 10 and washed and cleaned without risk of harm to container 10. And an individual insert can be removed and cleaned if it is the only insert which is dirty.

Figure 10A:
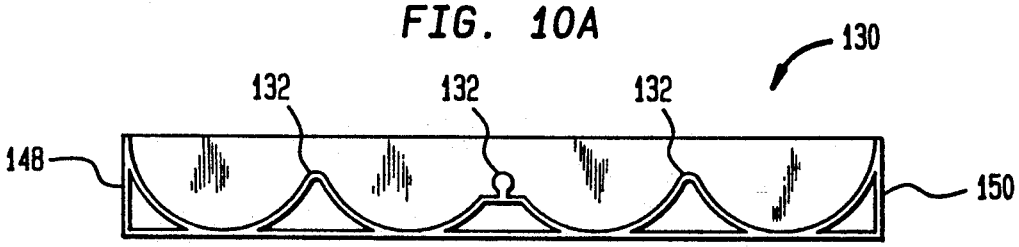
FIG. 10A is a front, cross-section view of a cooler adapter which converts the container constructed according to the present invention into a mini-cooler.
Figure 10B:
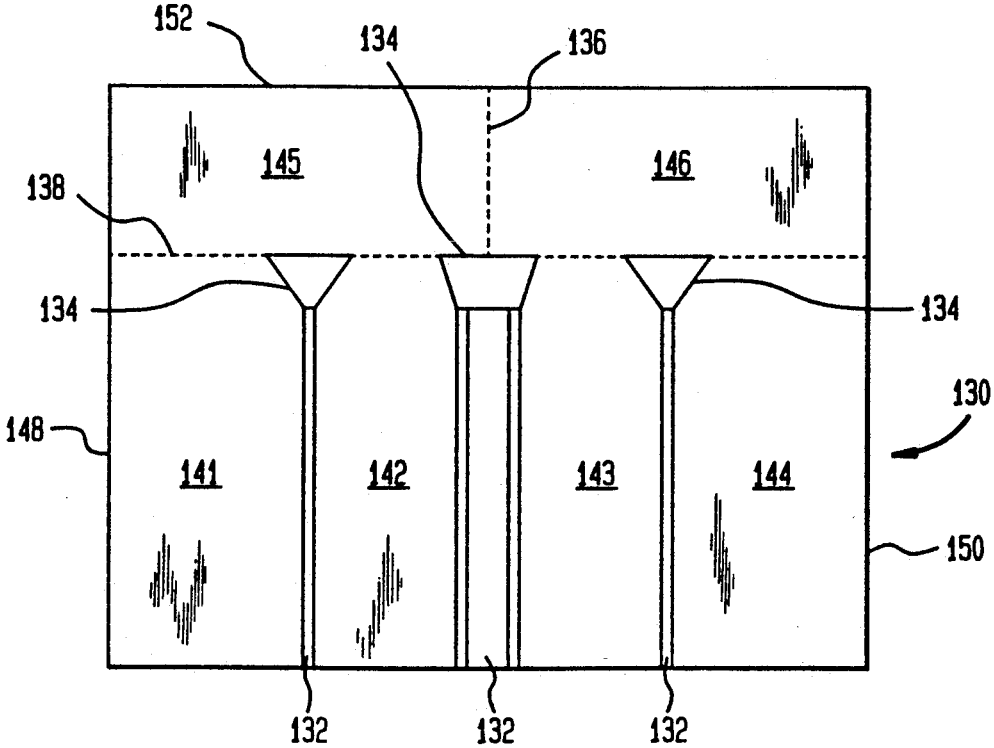
FIG. 10B is a top view of the cooler adapter shown in FIG. 10A.

Container 10 is versatile. After use as a briefcase, food and beverage carriage, or both, container converts to a six-pack mini-cooler. As a mini-cooler, container 10 accommodates a custom-made, freezable, resilient, contoured cooler adapter 130. Cooler adapter 130 includes two halves: a cover and a platform, each identically shaped as shown in FIGS. 10A and 10B. The only difference between the cover and the platform of cooler adapter 130 lies in their respective dimensions. The cover will snap or force-fit into the inside of container top 24 while the platform will snap or force-fit into container base 22. Because container base 22 has projection 58, for example, the platform of cooler adapter 130 may be less long than the cover. Similarly, because base 22 may be deeper than top 24, the platform may be higher than the cover. Each half of cooler adapter 130 has a series of three ridges 132 which end in webs 134 dividing it into six compartments 141, 142, 143, 144, 145, and 146. As shown in FIG. 10A, ridges 132, first side wall 148 of cooler adapter 130, and second side wall 150 of cooler adapter 130 are contoured to form four, cylindrically shaped compartments 141, 142, 143, and 144. Each compartment 141, 142, 143, and 144 accommodates a single can or bottle.

Webs 134 and face 152 of cooler adapter 130 also form two cylindrically shaped compartments 145, 146 aligned longitudinally along imaginary line 138 and oriented perpendicularly to compartments 141, 142, 143, and 144. Although an additional contoured ridge could be provided along imaginary line 136 to separate compartments 145 and 146, none is necessary: two, standard cans or bottles can be wedged, one in compartment 145 and the other in compartment 146, between first side wall 148 and second side wall 150. Thus, six, standard-sized cans or bottles can be safely stored in the cover and platform of cooler adapter 130.

In practice, the two halves (cover and platform) of cooler adapter 130 are frozen. The material used to form cooler adapter 130 is insulating and can maintain a nearly constant temperature for a number of hours. Then the platform is wedged inside base 22 of container 10. Six cans or bottles are placed, one each in compartment 141, 142, 143, 144, 145, and 146, in the platform. The cover of cooler adapter 130 is wedged inside top 24 of container 10. When top 24 is closed, the cover and platform halves of cooler adapter 130 will engage to encase and insulate each can or bottle in an individual compartment. Ridges 132 on the platform will contact identical ridges on the cover.

Both the platform and cover will contact the right side 23 of container 10 and the left side 25 of container 10. Similarly, both platform and cover will contact front 18 (through projection 58 in the case of the platform) and rear 19 of container 10. The platform will lie against container base 22; the cover will lie against container top 24. Thus, the halves of cooler adapter 130 are wedged in position and maximize use of the interior space within container 10.

Because the halves of cooler adapter 130 are wedged in position, they will remain in position when top 24 of container 10 is opened. Thus, upon opening top 24, immediate access to the cans or bottles within cooler adapter 130 is provided. The halves of cooler adapter 130 remain inside top 24 (the cover) and base 22 (the platform) on opening, unless specifically removed for cleaning or re-freezing.

Like the food and beverage carriage inserts discussed above, cooler adapter 130 is easy to clean and is dishwasher safe. Cooler adapter 130 can be removed easily from container 10 and washed and cleaned without risk of harm to container 10. Moreover, the platform or cover half of cooler adapter 130 can be removed and cleaned alone if it is the only half which is dirty.

Both the food and beverage carriage inserts and cooler adapter 130 may be provided with contoured bottoms and tops. If contoured, the insert or adapter will have contact rims to reduce the surface area of the insert or adapter which contacts base 22, top 24, or both of container 10. Reduced contact surface area can reduce thermal conduction between the insert and container 10.

With the food and beverage carriage inserts and cooler adapter 130 removed, container 10 can carry small books, magazines, papers, delicate and sensitive items (e.g., compact disks, tapes, computer disks, film, cameras, and the like), and other paraphenalia-functioning just as a conventional briefcase.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A container converting between a briefcase and, at separate times, a food and beverage carriage and a mini-cooler, said container comprising:

a case functioning as a briefcase and having:

(a) a base with walls defining a first hollow center filled with insulating material, and (b) a top with walls defining a second hollow center filled with insulating material and hingedly secured to said base along co-extensive edges;

a plurality of separate food and beverage carriage inserts removably positioned in said base for converting said case into a food and beverage carriage; and an insulating mini-cooler adapter for separately converting said case into a mini-cooler when said food and beverage carriage inserts are not positioned in said base.

2. A container according to claim 1 wherein each of said inserts have walls defining cavities filled with a gel allowing said inserts to be heated and cooled and to retain nearly constant temperature for a number of hours.

3. A container according to claim 1 wherein said case has a first side, a second side, a front, and a rear and said mini-cooler adapter has:

(a) a resilient cover adapted to snap into engagement with said top of said case, simultaneously engaging said first side, said second side, said front, and said rear of said case, and (b) a resilient platform adapted to snap into engagement with said base of said case, simultaneously engaging said first side, said second side, said front, and said rear of said case, said cover and said platform mating to encase and insulate at least one can when said top of said case is closed.

4. A container according to claim 1 wherein said case is made of resinous plastic.

5. A container according to claim 1 further comprising an O-ring and wherein:

said base has a channel along the entire periphery of said base;

said O-ring lies within said channel in said base; and said top has a lip along the entire periphery of said top, said lip engaging said channel in said base and contacting said O-ring in said channel to assure a vacuum-tight, leak-proof seal between said top and said base when said top is closed.

6. A container according to claim 5 wherein said O-ring is a compressible insulating material.

7. A container according to claim 1 wherein said separate food and beverage carriage inserts extend substantially completely into said top of said case.

8. A container according to claim 7 wherein said case has a front and a rear and said separate food and beverage carriage inserts wedge into position inside said case between said front and said rear of said case.

9. A container according to claim 1 wherein said mini-cooler adapter is made of a freezable insulator and maintains a nearly constant temperature for a number of hours.

10. A container according to claim 3 wherein said cover and said platform of said mini-cooler adapter each have corresponding contours dividing said mini-cooler adapter into a plurality of compartments, each said compartment accommodating a single can.

11. A container converting between a briefcase and, at separate times, a food and beverage carriage and a mini-cooler, said container comprising:

a case functioning as a briefcase and having:

(a) a base with walls defining a first hollow center filled with insulating material, (b) a top with walls defining a second hollow center filled with insulating material and hingedly secured to said base along co-extensive edges, (c) a rear, (d) a front, (e) a first side, and (f) a second side;

a plurality of separate food and beverage carriage inserts removably positioned in said base for converting said case into a food and beverage carriage, each of said inserts having walls defining cavities filled with a gel allowing said inserts to be heated and cooled and to retain nearly constant temperature for a number of hours; and an insulating mini-cooler adapted for separately converting said case into a mini-cooler when said food and beverage carriage inserts are not positioned in said base, said mini-cooler adapter having:

(a) a resilient cover adapted to snap into engagement with said top of said case, simultaneously engaging said first side, said second side, said front, and said rear of said case, and (b) a resilient platform adapted to snap into engagement with said base of said case, simultaneously engaging said first side, said second side, said front, and said rear of said case, said cover and said platform mating to encase and insulate at least one can when said top of said case is closed.

12. A container according to claim 11 wherein said case has a leather-like covering.

13. A container according to claim 11 wherein said case is made of resinous plastic.

14. A container according to claim 13 wherein said resinous plastic is high-impact styrene.

15. A container according to claim 11 wherein said case has approximate dimensions 11.5×8.5×3.5 inches.

16. A container according to claim 11 wherein said insulating material is high impact foam.

17. A container according to claim 11 further comprising an O-ring and wherein:

said base has a channel along the entire periphery of said base;

said O-ring lies within said channel in said base; and said top has a lip along the entire periphery of said top, said lip engaging said channel in said base and contacting said O-ring in said channel to assure a vacuum-tight, leak-proof seal between said top and said base when said top is closed.

18. A container according to claim 17 wherein said O-ring is a compressible insulating material.

19. A container according to claim 11 wherein said separate food and beverage carriage inserts extend substantially completely into said top of said case.

20. A container according to claim 19 wherein said separate food and beverage carriage inserts wedge into position inside said case between said front and said rear of said case.

21. A container according to claim 20 wherein said separate food and beverage carriage inserts include a thermos insert having a removable cap.

22. A container according to claim 21 wherein:

said thermos insert has a top with a slot;

said case has a rib located adjacent said front of said case near said base of said case; and said slot in said top of said thermos insert engages said rib to secure said thermos insert when said thermos insert is placed inside said case.

23. A container according to claim 20 wherein said separate food and beverage carriage inserts include a drinking cup insert.

24. A container according to claim 23 wherein said drinking cup insert fits over said cap of said thermos insert to prevent spills.

25. A container according to claim 20 wherein said separate food and beverage carriage inserts include at least one chamber insert.

26. A container according to claim 25 wherein said chamber insert is substantially rectangular and defines an opening suitable for holding food receptacles.

27. A container according to claim 26 wherein said chamber insert has a front wall with a track and a front door which slides along said track to prevent thermal exchange between said opening and the outside of said chamber insert when said front door is in a closed position and to allow access to said opening when said front door is in an open position.

28. A container according to claim 20 wherein said separate food and beverage carriage inserts include at least one partition insert.

29. A container according to claim 28 wherein said partition insert is substantially rectangular, has an end, and has an L-shaped cutout in said end.

30. A container according to claim 29 wherein said front of said case has a projection and said cutout of said partition insert engages said projection to secure said partition insert within said case.

31. A container according to claim 29 wherein said case has a rib located adjacent said front of said case near said base of said case, said partition insert has a groove, and said groove of said partition insert engages said rib of said case to secure said partition insert within said case.

32. A container according to claim 20 wherein said separate food and beverage carriage inserts include at least one can insert.

33. A container according to claim 32 wherein said can insert has a cylindrically shaped trough to accommodate a can.

34. A container according to claim 11 wherein said mini-cooler adapter is made of a freezable insulator and maintains a nearly constant temperature for a number of hours.

35. A container according to claim 34 wherein said cover and said platform of said mini-cooler adapter each have corresponding contours dividing said mini-cooler adapter into a plurality of compartments, each said compartment accommodating a single can.

36. A container converting between a briefcase and a food and beverage carriage comprising:

a case functioning as a briefcase and having:

(a) a base with walls defining a first hollow center filled with insulating material, (b) a top with walls defining a second hollow center filled with insulating material and hingedly secured to said base along co-extensive edges, (c) a rear, and (d) a front; and a plurality of separate food and beverage carriage inserts removably positioned in said base for converting said case into a food and beverage carriage, each of said inserts having walls defining cavities filled with a gel allowing said inserts to be individually heated and cooled and to retain nearly constant temperature for a number of hours.

37. A container according to claim 36 wherein said case is made of resinous plastic.

38. A container according to claim 36 further comprising an O-ring and wherein:

said base has a channel along the entire periphery of said base;

said O-ring lies within said channel in said base; and said top has a lip along the entire periphery of said top, said lip engaging said channel in said base and contacting said O-ring in said channel to assure a vacuum-tight, leak-proof seal between said top and said base when said top is closed.

39. A container according to claim 38 wherein said O-ring is a compressible insulating material.

40. A container according to claim 36 wherein said separate food and beverage carriage inserts extend substantially completely into said top of said case.

41. A container according to claim 40 wherein said separate food and beverage carriage inserts wedge into position inside said case between said front and said rear of said case.

42. A container converting between a briefcase and a mini-cooler comprising:

a case functioning as a briefcase and having:

(a) a base with walls hollow center filled with insulating material, (b) a top with walls defining a second hollow center filled with insulating material and hingedly secured to said base along co-extensive edges, (c) a rear, (d) a front, (e) a first side, and (f) a second side; and an insulating mini-cooler adapter for converting said case into a mini-cooler, said mini-cooler adapter having:

(a) a resilient cover adapted to snap into engagement with said top of said case, simultaneously engaging said first side, said second side, said front, and said rear of said case, and (b) a resilient platform adapted to snap into engagement with said base of said case, simultaneously engaging said first side, said second side, said front, and said rear of said case, said cover and said platform mating to encase and insulate at least one can when said top of said case is closed.

43. A container according to claim 42 wherein said case is made of resinous plastic.

44. A container according to claim 42 further comprising an O-ring and wherein:

said base has a channel along the entire periphery of said base;

said O-ring lies within said channel in said base; and said top has a lip along the entire periphery of said top, said lip engaging said channel in said base and contacting said O-ring in said channel to assure a vacuum-tight, leak-proof seal between said top and said base when said top is closed.

45. A container according to claim 44 wherein said O-ring is a compressible insulating material.

46. A container according to claim 42 wherein said mini-cooler adapter is made of a freezable insulator and maintains a nearly constant temperature for a number of hours.

47. A container according to claim 42 wherein said cover and said platform of said mini-cooler adapter each have corresponding contours dividing said mini cooler adapter into a plurality of compartments, each said compartment accommodating a single can.

* * * * *